United States Patent [19]

Barber, Jr.

[11] 4,055,374

[45] Oct. 25, 1977

[54] LAMP FIXTURE CONVERSION METHOD

[76] Inventor: Womack Hardy Barber, Jr., 613 Parkview Drive, Durham, N.C. 27712

[21] Appl. No.: 722,224

[22] Filed: Sept. 10, 1976

[51] Int. Cl.[2] ..... H01J 9/50

[52] U.S. Cl. ..... 316/2

[58] Field of Search ..... 316/2, 28, 17; 240/25, 240/51.11 R, 11.4 R, 52 HT, 86, 153; 269/43; 29/25.13, 25.15, 25.16

[56] References Cited

U.S. PATENT DOCUMENTS

| | | | |
|---|---|---|---|
| 1,781,997 | 11/1930 | Berezowski | 260/43 X |
| 3,065,339 | 11/1962 | Fahey, Jr. | 240/25 |
| 3,267,276 | 8/1966 | Hasler | 240/25 |
| 3,317,724 | 5/1967 | Pfaff, Jr. et al. | 240/25 X |
| 3,342,988 | 9/1967 | Farrington | 240/25 X |
| 3,836,954 | 9/1974 | Adam | 240/11.4 R |

*Primary Examiner*—Richard B. Lazarus
*Attorney, Agent, or Firm*—B. B. Olive

[57] ABSTRACT

Disclosed is an apparatus and method for converting mercury lamp fixtures to low pressure sodium lamp fixtures. The original mercury vapor lamp, and its respective socket and socket support bracket are removed from the mercury lamp fixture. Utilizing the same fixture housing and enclosed relfector, a new socket is mounted external of the reflector so that the reflector may accommodate the longer low pressure sodium lamp. A novel U-shaped bracket is utilized for supporting the sodium lamp socket and has adjustable mounting features so that it may be used with a variety of fixtures. An auxiliary sodium lamp support is mounted inside the reflector to support the remote end of the sodium vapor lamp.

5 Claims, 9 Drawing Figures

FIG. 7
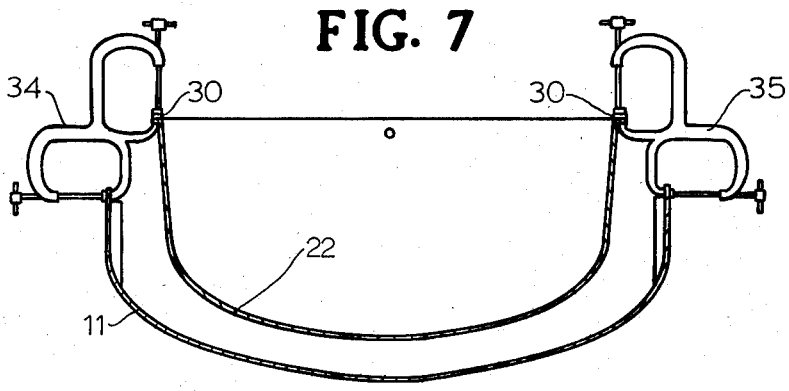
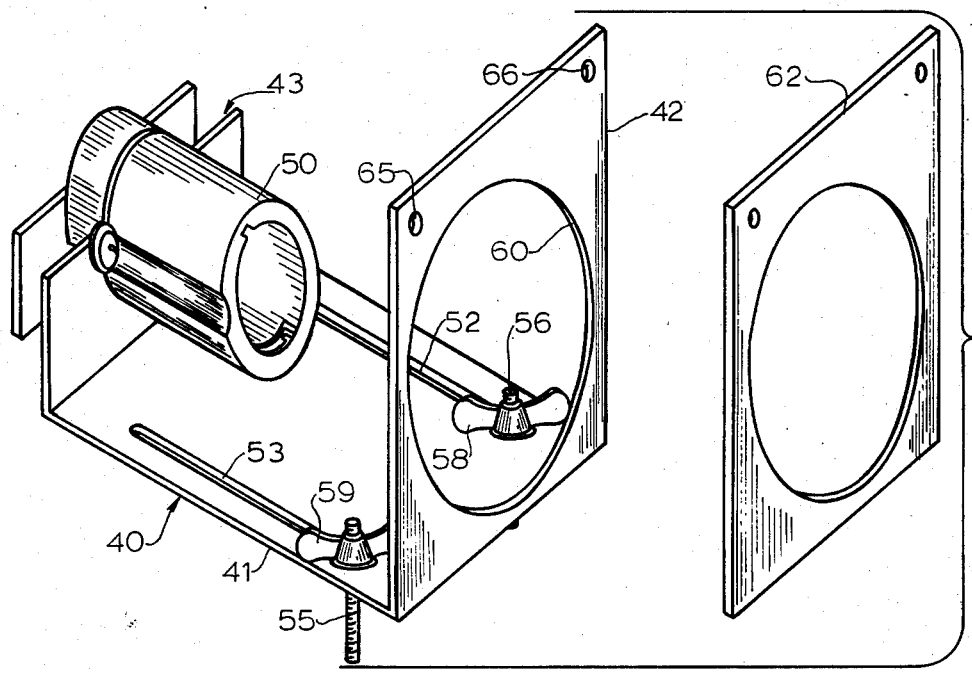
FIG. 8
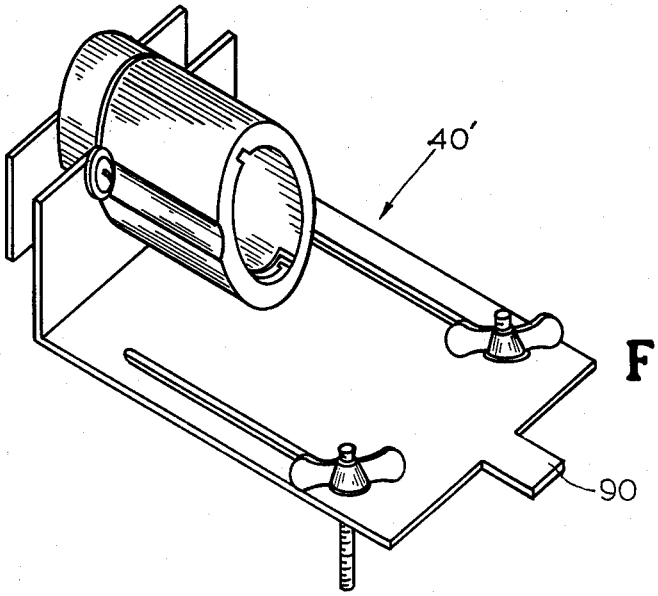
FIG. 9

LAMP FIXTURE CONVERSION METHOD

BACKGROUND OF THE INVENTION

1. Field of the Invention

The invention relates to fixtures for discharge-type electric lamps. In particular, the invention relates to an apparatus and method for converting a mercury lamp fixture to a low pressure sodium lamp fixture.

2. Description of the Prior Art

Approximately 25 million mercury vapor lamps are presently in use. A large percentage of these lamps, especially those utilized as street lights, are mounted in elongated fixtures having a substantially hemispherical reflector enclosing the lamp and having a light-dispensing lens covering the reflector. The mercury vapor lamps inherently have a relatively low light efficiency on the order of 50 lumens per watt. As the conservation of all forms of energy, electrical energy in particular, becomes increasingly important, it has become essential to find a higher efficiency light source for streetlights, industrial lights, quarry and mine lights, and similar applications. In addition to the relatively low efficiency of the mercury vapor lamps, recently it has been suggested that such lamps, when damaged, emit ultraviolet radiation which may be a potential cause of skin cancer, cataracts and temporary blindness.

It is well known that low pressure sodium lamps offer a number of inherent advantages over mercury vapor lamps. For example, low pressure sodium lamps have a light efficiency on the order of 180 lumens per watt which is the highest efficiency of any commercially available lamp. The sodium lamps produce a spectral light output closely corresponding to the peak response of the human eye thereby creating improved nighttime visibility. Furthermore, such lamps have no ultraviolet output and are capable of operation in virtually any weather conditions. Other well-known features of low pressure sodium lamps include their high performance in fog and mist conditions, their nonpolluting characteristics and their low operating temperatures.

Previous attempts to convert mercury lamp fixtures to low pressure sodium lamp fixtures involved either the replacement of the entire fixture or the replacement of substantially all of the internal parts of the fixture, including the reflector. Since the rising cost of electrical energy, in combination with the dramatic increase in efficiency of modern generation low pressure sodium lamps, has made it economically feasible to convert existing mercury lamp fixtures to low pressure sodium lamp fixtures, it becomes an object of the invention to provide an apparatus and method for making such conversions with a minimum alteration in the existing fixtures and with the additional benefits of reduced health risks and optimum spectral light output.

SUMMARY OF THE INVENTION

The present invention provides an apparatus and method for converting a lamp fixture of the type containing a mercury vapor lamp to a fixture containing a low pressure sodium lamp. The fixture is first removed from its mounting location and placed on a worktable in an inverted position. The lower housing half of the fixture is removed to expose the internal components of the fixture. During the conversion operation, the reflector is secured to the fixture housing to prevent relative movement between the reflector and the housing. Next, the mercury vapor lamp and its socket are removed.

Any electrical components not compatible with low pressure sodium lamp operation are removed and replaced with compatible components. A novel U-shaped bracket is affixed to the outside surface of the reflector and is utilized to mount a sodium lamp socket totally external of the reflector. A low pressure sodium lamp is installed in the socket and extends from a position external of the reflector to a point near the forward end of the reflector. The lamp is supported at its forward end by an auxiliary lamp support.

DESCRIPTION OF THE DRAWINGS

FIG. 7 is a section view of the fixture taken substantially along line 7—7 of FIG. 5 and showing the jigs which hold the reflector in place during the conversion operation.

FIG. 8 is an enlarged, front perspective view of the bracket for mounting the sodium lamp socket.

FIG. 9 is a perspective view of an alternative bracket for mounting the sodium lamp socket.

DESCRIPTION OF THE PREFERRED EMBODIMENT

Figure 1:
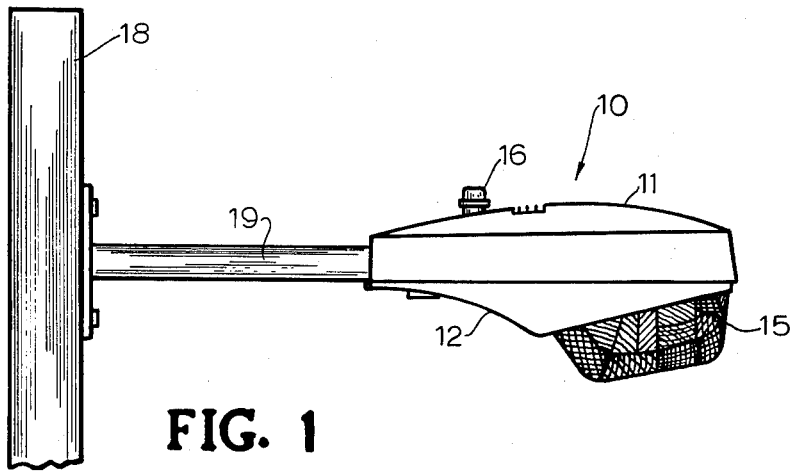
FIG. 1 is a side view of a conventional mercury vapor lamp fixture operatively mounted on a light pole.
Figure 2:
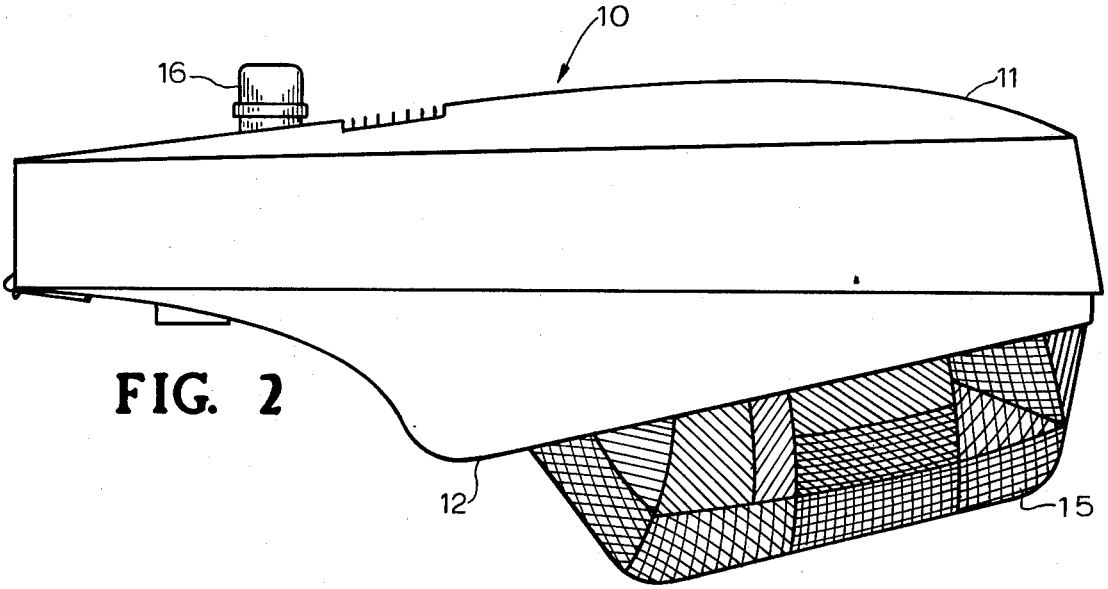
FIG. 2 is an enlarged side view of the fixture shown in FIG. 1.

Referring to the drawings and particularly to FIGS. 1 and 2, there is shown a conventional mercury lamp fixture 10 mounted on a light pole 18 and horizontal mounting rod 19 for use as a highway light, security light, or like use. As best shown in FIG. 2, fixture 10 includes an upper housing half 11, a lower housing half 12, a lens 15 and a photoelectric cell 16 utilized as an on-off control.

Figure 3:
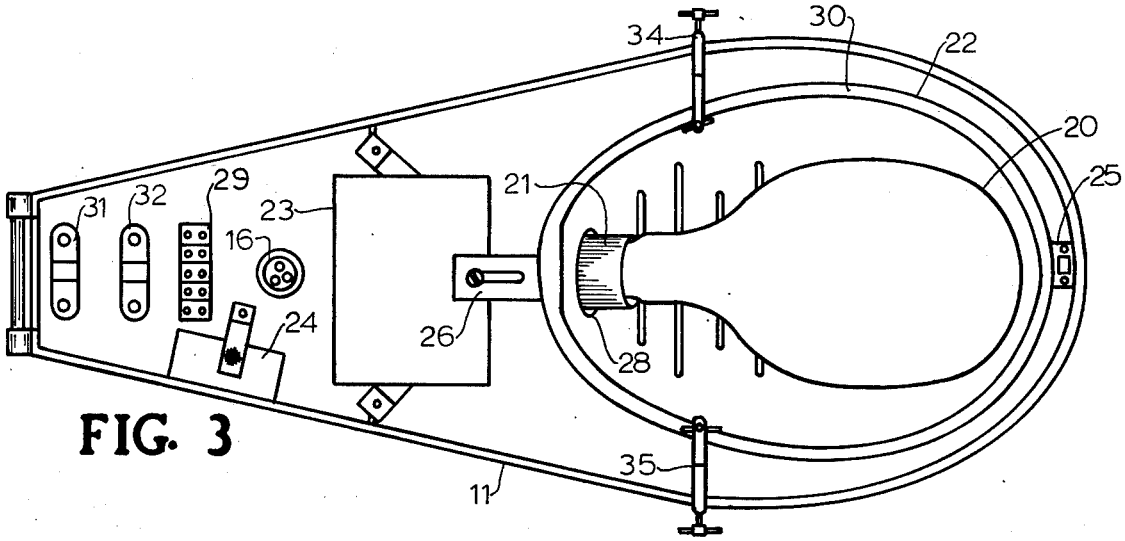
FIG. 3 is a top view of an inverted fixture with the lens and lower housing half removed and with the reflector clamped in place.
Figure 4:
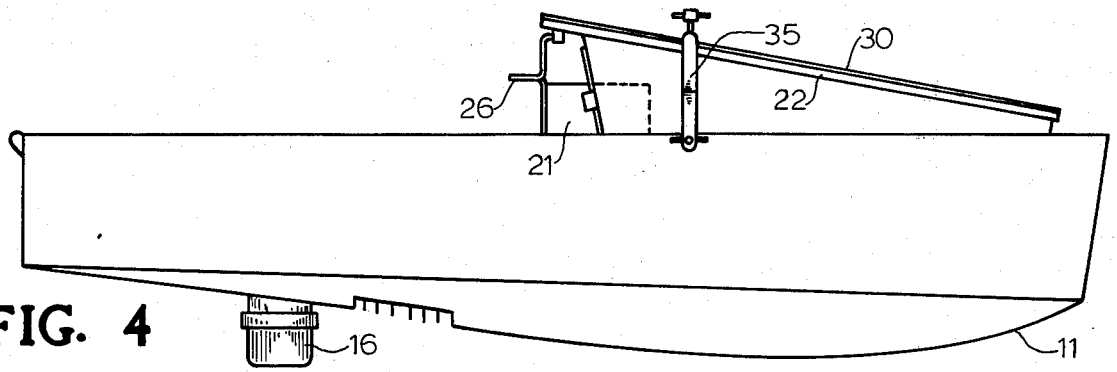
FIG. 4 is a side view of the fixture illustrated in FIG 3.

FIGS. 3 and 4 illustrate the fixture 10 after clamps, 31, 32 (FIG. 3) have been released from rod 19 and the fixture has been placed upon a worktable in an inverted position with the lower housing half 12 removed. The interior portion of fixture 10 includes a conventional mercury vapor lamp 20 mounted in a socket 21 and residing within a substantially hemispherical reflector 22. A suitable ballast 23 and capacitor 24 are mounted within housing half 11 and are electrically connected to socket 21 and to the power source through a circuit panel 29. Conventional electrical wiring connects the electrical components of the original mercury lamp fixture and the converted sodium lamp fixture and such wiring will not be shown or described. Reflector 22 is held in place by a front mounting bracket 25 and a rear mounting bracket 26 which also serves as a support for socket 21. Socket 21 extends through a circular opening 28 in reflector 22. To prevent the accumulation of dust within reflector 22, the space between reflector opening 28 and socket 21 is sealed with a seal made from felt or other suitable material. Also, the edge surface of reflector 22 is provided with a seal 30 which engages a mating surface on lens 15 when the fixture is assembled. These two seals prevent dust from being drawn into the reflector when the lamp is turned off and the air inside the reflector cools.

During the conversion operation, the reflector 22 must be held stationary with respect to fixture housing half 11 so that seal 30 will properly align with and engage its respective mating surface on lens 15 when the fixture is reassembled. As will be pointed out below, during the conversion process bracket 21 is removed, and without some means to hold reflector 22 in place, the reflector would shift. Reflector 22 is therefore held in place by a pair of jigs 34, 35. Jigs 34, 35 each include two "C" clamps which are welded or otherwise suitably secured together into a novel composite jig device which is best shown in FIG. 7.

Figure 5:
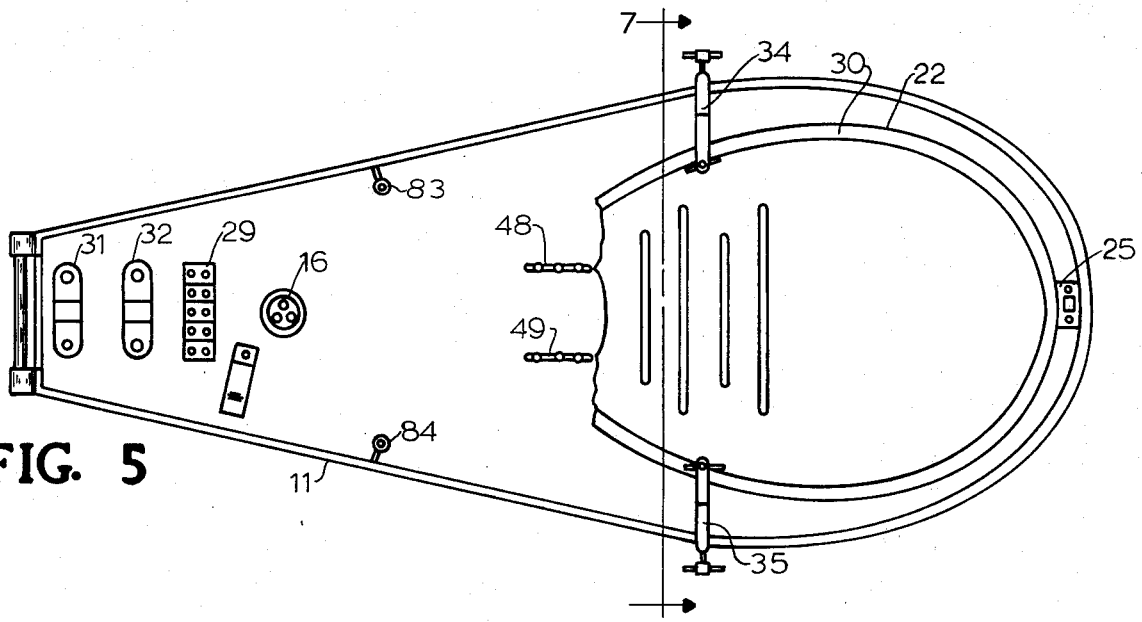
FIG. 5 is a view similar to FIG. 3 with the mercury vapor lamp, socket, socket support bracket, ballast and capacitor removed and with the rear portion of the reflector broken away for purposes of illustration.
Figure 6:
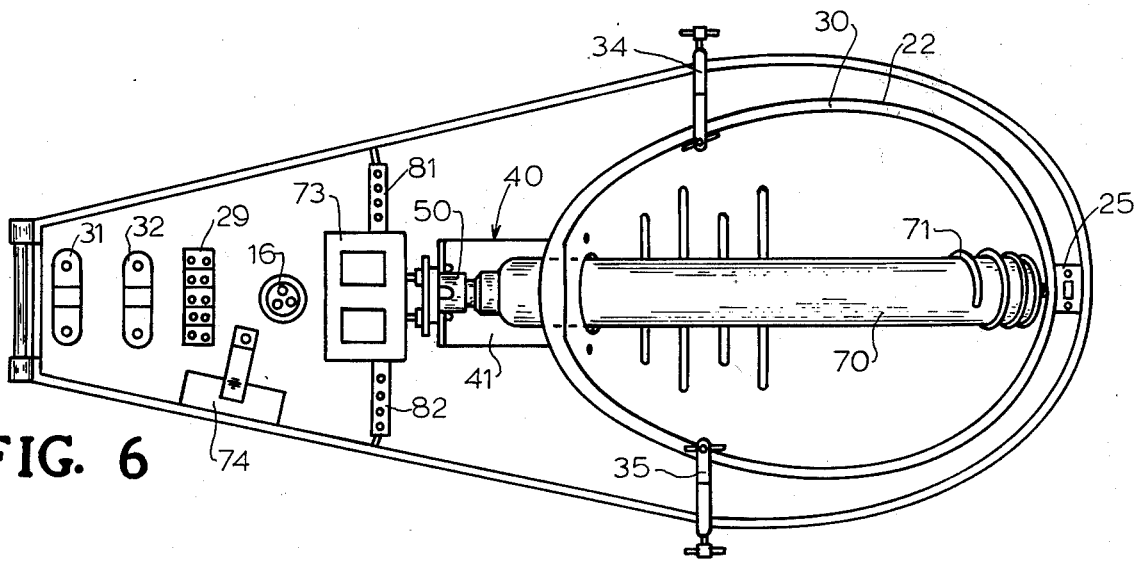
FIG. 6 is a view similar to FIGS. 3 and 5 showing the fixture converted to a low pressure sodium lamp fixture.

With reflector 22 securely anchored to the fixture body, the conversion of fixture 10 proceeds with the removal of the mercury vapor lamp 20, socket 21, support bracket 25 and its associated socket seal, ballast 23 and capacitor 24 (FIG. 5). Referring to FIGS. 6, 8 and 9, a replacement bracket 40 is installed utilizing the threaded holes in the boss formations 48, 49 to which the original socket support bracket was secured. In the specific embodiment, bracket 40 is substantially U-shaped and comprises a base 41, a front upright portion 42 and a rear upright portion 43 that mounts a sodium lamp socket 50. Base 41 includes a pair of slots 52, 53 for adjustably mounting bracket 40 to the fixture by means of a pair of bolts 55, 56 which thread into holes in bosses 48, 49 and are tightened by wing members 58, 59. Bracket 40 is mounted so that front upright 42 engages the outer wall surface of reflector 22 and so that aperture 60 aligns with opening 28 in the reflector. A suitable seal 62 is secured between upright 42 and reflector 22 to serve as a seal around the portion of the sodium vapor lamp which extends through aperture 60 and opening 28. In order to secure upright 42 to reflector 22, a pair of holes are drilled into reflector 22 to align with holes 65, 66 in upright 42. Bolts inserted in these mating holes or other suitable means may be employed to secure the reflector to the upright. Mounted on the rear upright 43 is the sodium lamp socket 50 which, when so mounted, is completely external of reflector 22. Socket 50 is so mounted because the replacement low pressure sodium lamp having a comparable light output to the original mercury vapor lamp is substantially longer than the interior dimensions of the reflector 22 and must, therefore, extend beyond the reflector. As best shown in FIG. 6, the low pressure sodium lamp 70 mounts in socket 50 and extends to the forward end where an auxiliary lamp support 71, in the form of a coil, is provided to support the forward end of lamp 70.

After lamp 70 has been installed and reflector 22 has been securely mounted by means of bracket 40, jigs 34, 35 may be removed. A new high power factor ballast 73 is installed utilizing adjustable brackets 81, 82 which are secured to the existing boss formations 83, 84 by means of bolts or the like. A compatible capacitor 74 is mounted by the existing bracket. Ballast 73 and capacitor 74 are appropriately connected to the circuit panel 29. The converted unit may then be tested to assure that all electrical connections have been made correctly. Next, the reflector and lens are cleaned and then housing half 12 is secured in place with care being taken to see that seal 30 is properly aligned. The converted fixture is now ready to be installed.

FIG. 9 illustrates an alternative embodiment of the sodium lamp support bracket. Bracket 40' differs from the previously described bracket 40 only in that the front upright has been removed and replaced with a tab member 90. Tab 90 is adapted to lie in firm engagement with opening 28 in reflector 22 when bracket 40' is secured into place. When the fixture housing halves 11, 12 are reassembled after the conversion operation, tab 90 will prevent movement of the reflector. Because tab 90 is not secured to reflector 22 by bolts or the like, the fixture may be easily disassembled for cleaning and repairs.

It will be appreciated that the method of the present invention may be practiced on any existing mercury lamp fixture of the type employing an internal reflector which houses the lamp and which has an opening for receiving the lamp socket. While the invention has been described as applied to a particular fixture having a ballast and capacitor within the housing, the invention may be practiced on fixtures having virtually any combination of internal electrical components provided that the original electrical components which are incompatible with low pressure sodium lamp operation are replaced by compatible conponents. It is critical in all applications of the invention that the new sodium lamp socket be located external of the reflector and in line with the existing reflector opening. Also critical is that the reflector not shift relative to the housing during the conversion operation so that the reflector seal will be in the proper position when the fixture is reassembled. To this end, a novel jig construction comprising a pair of joined C-clamps has been utilized to secure the reflector to the housing.

Thus, it can be seen that the art is now provided with a simple and economical method for converting mercury lamp fixtures to low pressure sodium lamp fixtures. For purposes of illustration, the invention has been explained with reference to the conversion of an ITT "cobra head" type fixture; however, the apparatus and method of the invention may be used in the conversion of other comparable fixtures and may utilize any suitable low pressure sodium lamp and socket.

What is claimed is:

1. A method of converting a lamp fixture of the type containing a mercury vapor lamp to a fixture containing a low pressure sodium lamp comprising the steps of a. removing the fixture from its respective mounting location;

b. inverting the fixture and removing the fixture lower housing half and associated lens;

c. removing the mercury vapor lamp from its socket in said fixture;

d. anchoring the fixture reflector to the fixture housing to prevent relative movement between the reflector and the housing during the conversion operation;

e. removing the mercury vapor lamp socket and any associated socket seals;

f. removing any electrical components associated with the mercury vapor lamp operation not compatible with low pressure sodium lamp operation and replacing the same with electrical components compatible with the desired low pressure sodium lamp operation;

g. affixing a bracket to the inner wall surface of the upper housing half rearward of said reflector, said bracket mounting a sodium lamp socket external of said reflector and aligned with the existing socket opening in the reflector and said bracket having a forward member engaging said reflector;

h. installing a low pressure sodium lamp in its respective socket, whereby such sodium lamp extends from its socket external of the reflector to a point proximate the forward end of the reflector; and i. replacing the fixture lower housing half and lens while aligning the seal portion of said reflector with the mating portion on said lens.

2. A method as claimed in claim 1 including the step of providing an auxiliary sodium lamp support at the forward end of said reflector.

3. A method as claimed in claim 1 wherein said bracket is substantially U-shaped with a base portion secured to the fixture housing, a front upright portion affixed to the reflector outside surface and a rear upright portion mounting said socket.

4. A method as claimed in claim 3 wherein said bracket base includes slot formations therein adapting said bracket to mount fixtures of different constructions.

5. A method as claimed in claim 1 wherein said reflector anchoring is performed by at least two jigs each formed from a pair of joined C-clamps.

* * * * *